US010612320B2

(12) United States Patent
Nommensen et al.

(10) Patent No.: US 10,612,320 B2
(45) Date of Patent: Apr. 7, 2020

(54) ADVANCE FAILURE WARNING APPARATUS AND SYSTEM FOR DOWNHOLE GEAR

(71) Applicant: Cobalt Extreme Pty Ltd., East Brisbane (AU)

(72) Inventors: Arthur Charles Nommensen, Launceston (AU); David C. Nommensen, East Brisbane (AU)

(73) Assignee: COBALT EXTREME PTY LTD., East Brisbane (AU)

( * ) Notice: Subject to any disclaimer, the term of this patent is extended or adjusted under 35 U.S.C. 154(b) by 93 days.

(21) Appl. No.: 15/661,447

(22) Filed: Jul. 27, 2017

(65) Prior Publication Data

US 2018/0080288 A1 Mar. 22, 2018

(30) Foreign Application Priority Data

Dec. 21, 2016 (AU) ..... 2016277644

(51) Int. Cl.
*E21B 17/10* (2006.01)
*E21B 43/12* (2006.01)

(52) U.S. Cl.
CPC ..... *E21B 17/1078* (2013.01); *E21B 43/126* (2013.01)

(58) Field of Classification Search
CPC ..... E21B 17/1078; E21B 17/10; E21B 7/04
See application file for complete search history.

(56) References Cited

U.S. PATENT DOCUMENTS 3,613,783 A * 10/1971 Seabourn ..... E21B 17/1078 166/241.6

* cited by examiner

*Primary Examiner* — David J Bagnell
*Assistant Examiner* — Dany E Akakpo
(74) *Attorney, Agent, or Firm* — Greer, Burns & Crain, Ltd.

(57) ABSTRACT

A wear prevention system for a pumping system of a oil or gas well, the system comprising a sucker rod string comprising a plurality of rod components, a production pipe string, couplers for the rod components and centralizers for the rod components within the production pipe wherein centralizers are on the couplers. The centralizers contain integral signal mediums which are released as the centralizer becomes worn. The sucker rod string comprises rod components of different lengths and the rod components of relative shortest length are positioned at points of greatest curvature in the well. The rod components of relative shortest length have centralizers which contain different signal mediums to the rod components of relative longest length.

12 Claims, 4 Drawing Sheets

"Prior Art"

ADVANCE FAILURE WARNING APPARATUS AND SYSTEM FOR DOWNHOLE GEAR

TECHNICAL FIELD

The present invention relates generally to mining equipment and, more particularly to an anti-wear system for sucker rods working within production piping of oil and gas wells.

BACKGROUND

In a typical coal seam gas and oil well 10, a sucker rod string 12 is lowered down the inside of a production pipe 14, as shown in FIG. 1. The production pipe 14 follows an underground coal seam 15. The sucker rod string 12 is driven by a motor 16 at the ground surface 18. The motor 16 rotates or reciprocates the sucker rod string 12 (depending on the type of pump) in order to drive a removal pump 20 mounted at the bottom of the well 10. The oil, water, entrained sand and coal dust particles form an abrasive fluid which gets pumped to the ground surface 18 by passing up the inside of the production pipe 14 within which the sucker rod string 12 which is rotating. Such a sucker rod string 12 is made up by screwing together rod components 22 shown in FIGS. 1 and 2.

Referring to FIG. 2, the rod components 22 are steel bars (which are typically 8 meters long and around 22.5 mm in diameter). The rod components 22 are connected by interposing a coupler 24 (having a female thread) between each rod component 22 (having a male thread). The total length of the sucker rod string 12 down the well 10 may be perhaps 600 metres long. The sucker rod string 12 may rotate at around 300 rotations per minute to drive the bottom-hole pump 20. The well 10 may be deviated from vertical, so that the rod string 12 must rotate within a pipe 14 that is descending thorough the production pipe 14. However, as the pipe production 14 is deviated and the fluid being pumped is highly abrasive, the sucker rod string 12 and the production pipe 14 are rapidly worn. Wear points 21 are shown on the sucker rod string 12 in FIG. 1. This frequently leads to a failure of the well 10 which is costly to repair.

The method which is commonly used to minimise the wear of the rod components and pipes involves the use of rod guides called "centralisers" made from a wear resistant polymer. These centralisers are attached to each rod component and act as bearings and spacers to keep the rotating rod components away from the internal surface of the pipes. There are two popular methods of connecting centralizers to sucker rods. The first method involves manufacturing the centralizers in a factory, transporting the centralizers to a well and then manually connecting the centralizers to the sucker rods using a clip-on mechanism. A prior art centralizer 26 is shown in FIG. 2 on a sucker rod component 22. Another popular method of attaching centralizers to the sucker rod involves attaching a mould to a sucker rod and injecting the mould with plastic. The mould is then removed, leaving a moulded centralizer 26 attached to a sucker rod component 20. Typically around three centralizers are attached to each sucker rod component 22.

However, due to the extremely abrasive nature of the sand and formation coal fines, the prior art centralizers 26 are prone to rapid wearing. This exposes the sucker rod string 12 and production pipe 14 to damage and frequently results in the failure of the well. To exacerbate the problem, the operator has no method of detecting that the abrasion damage has reached critical levels, so that by the time the operator finds out the well is not operating the internal components of the sucker rod string and production pipe may already be destroyed.

It is an object of the invention to provide a centralizer Which is longer wearing and provides a signal for the onset of wear before damage occurs to the sucker rod and production pipe.

SUMMARY OF INVENTION

According to the present invention there is provided a wear prevention system for a pumping system of an oil or gas well, the system comprising:

(a) a sucker rod string comprising a plurality of rod components;

(b) a production pipe string;

(c) couplers for the rod components; and (d) centralizers for the rod components within the production pipe;

wherein centralizers are integrally moulded on the couplers.

Preferably, the centralizer has at least one cavity defined in the centralizer for containing a signal medium, wherein the cavity is sealed until wear of the centralizer breaches the cavity and the signal medium is released. More preferably, the centralizers have cavities at different depths and contain different signal mediums, so that different signals are released for different levels of wear. It is preferred that the signal medium is located toward the top of the centralizer toward the surface of the well. The centralizer is a pressure densified polymer in preferred forms of the invention. In other preferred embodiments of the invention, the production pipe string has a coating on its inner surface.

The sucker rod string may comprise sucker rod components of different lengths and the rod components of the relative shortest length may be positioned at points of greatest curvature in the well.

BRIEF DESCRIPTION OF DRAWINGS

The Detailed Description will make reference to a number of drawings as follows.

DETAILED DESCRIPTION

Figure 3:
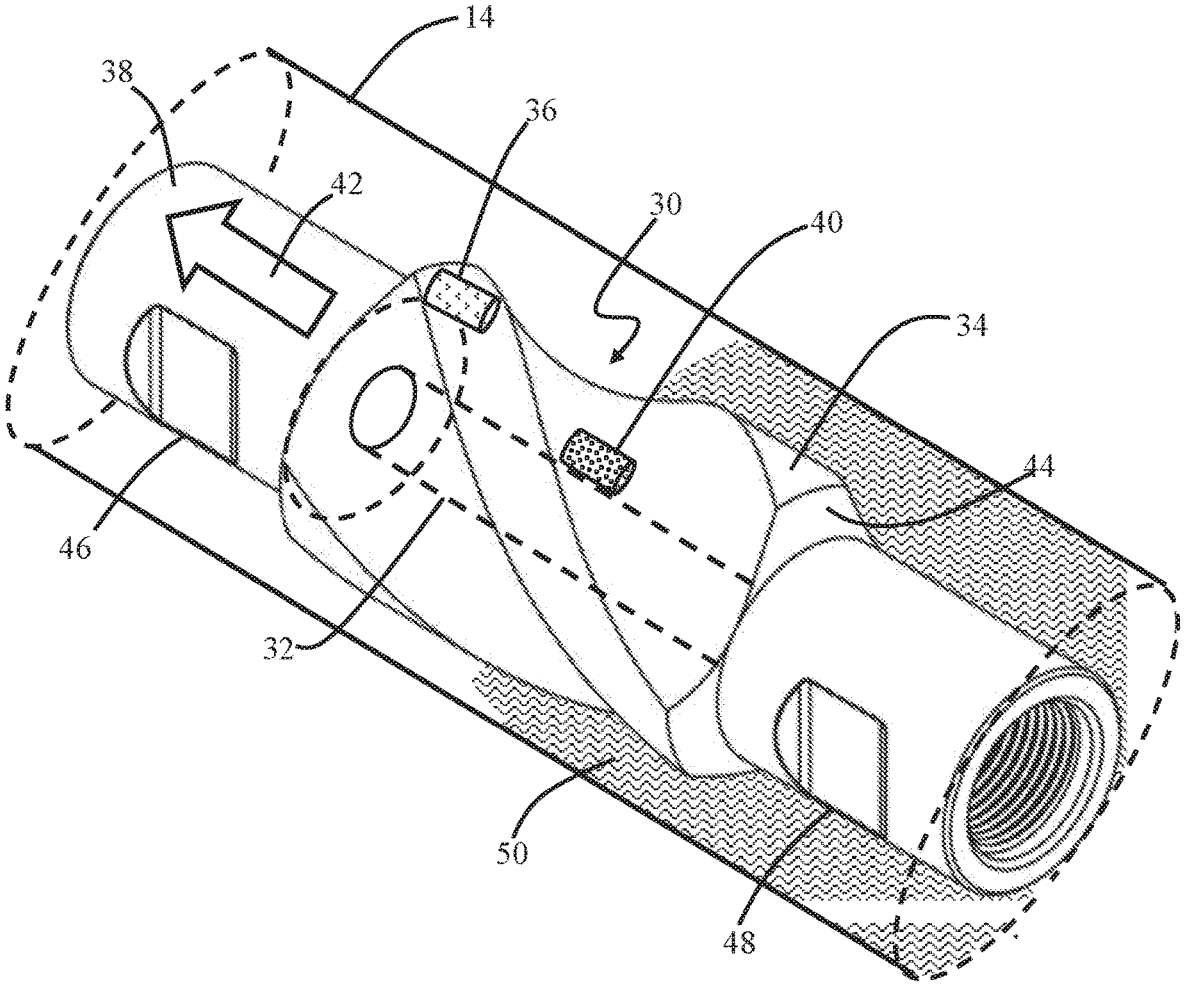
FIG. 3 is a coupler with an integrally moulded centralizer according to the present invention.
Figure 4:
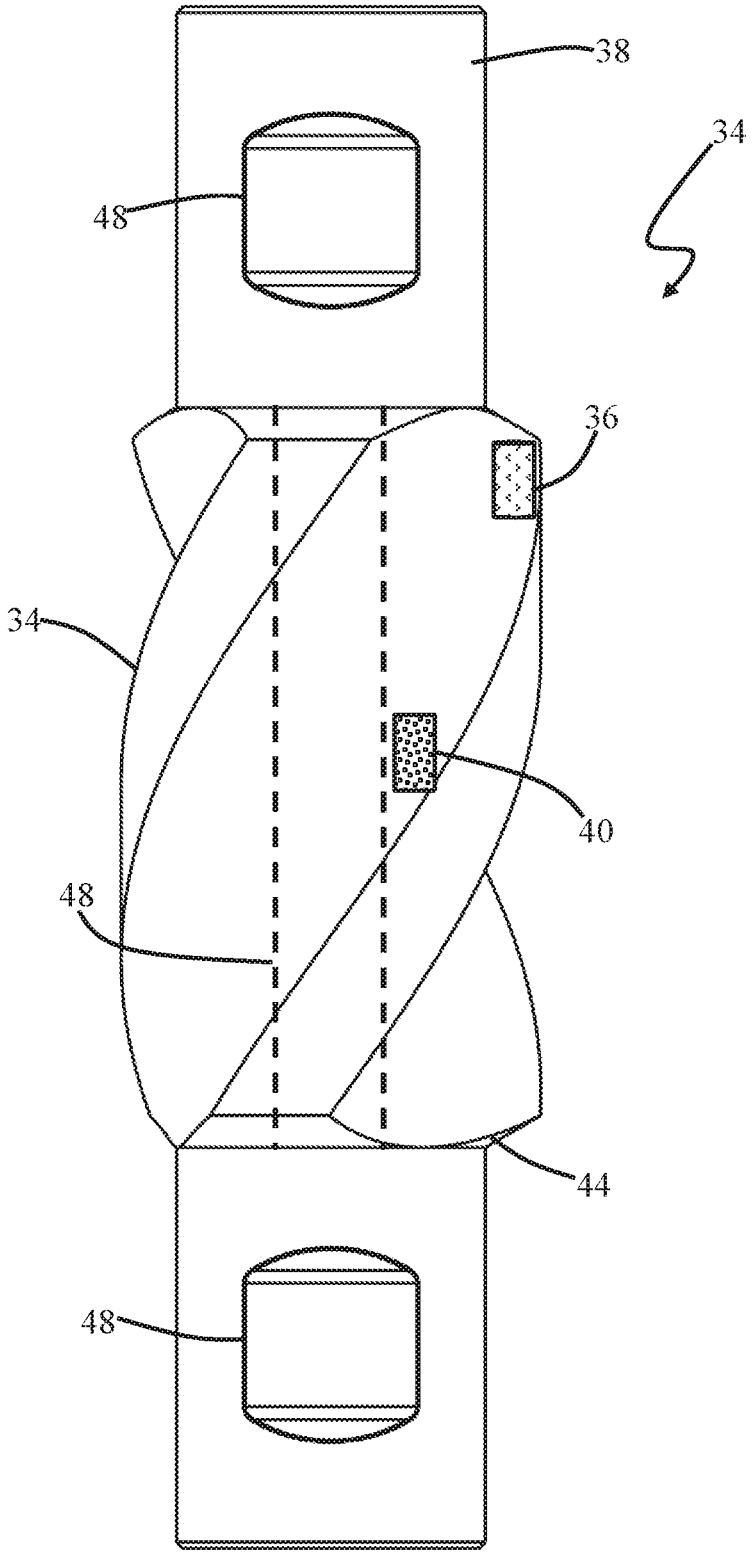
FIG. 4 is a side view of the coupler of FIG. 3.

Prior art systems for wear prevention of sucker rods in production pipes involve attaching rod guides called "centralizers" along the length of the rod components. However, in the present invention, the centralizers are integrally moulded onto the couplers between each rod component. FIGS. 3 and 4 show a coupler 30 according to an embodiment of the present invention, which has a metal axle 32 overlayed with a centralizer 34. The centralizer 34 has a spiral formation to facilitate the upward movement of the fluid in the production pipe 14. The centralizer 34 is made from plastic, which is produced by injection moulding and then compressed by the injection moulding process as the plastic cools, in order to increase its density. The increased density of the plastic makes the centralizer 34 more resistant to wear. The density of the plastic is akin to the density of a car tyre, which although soft, is dense and long wearing. If the plastic is not densified, or is hard, it becomes more abrasive to the production pipe 14.

By contrast, some prior art centralizers comprise glass filled plastic resins, which increase the hardness of the centralizers. However, the hardness of the plastic increases the wear on the production pipe. Some centralizers are designed to spin around the sucker rod components to reduce the wear the production pipe. However, if the centralizers are allowed spin, then the spinning motion increases the wear on the sucker rod components. The inventors have found that the relative softness of the plastic in the centralizers 34 of the present invention increases the life of the centralizers 34 in most contexts.

The coupler 30 features a wear signalling mechanism in the form of man-made chemical deposits recessed into the centralizer 34. The deposits contain chemicals which are not naturally present and are released into the fluid stream in the event that the plastic in the centralizer 34 is worn down. One such chemical which can be used in the deposits is calcium carbide. Calcium carbide produces acetylene gas when it comes in contact with water. The acetylene gas is not normally in nature and can be detected in minute quantities in the fluids arriving at the surface of the well. A gas detector can be used to detect the presence of acetylene gas in the fluid stream. Another chemical which can be used in the deposits is nitrates, which are also not normally present in underground deposits. Minute quantities of nitrates can be easily detected directly in the liquid fluid of the stream (for example, by detectors for explosives).

It is advantageous to have deposits which contain different chemicals located at different depths within the centralizer 34, so that the relative wear of the centralizer can be determined. The coupler 30 has a first deposit 36 which is located towards the top of the centralizer 34 (as indicated by arrow 42) and near the outer diameter of the centralizer 34. The centralizer 34 also has a second deposit 40 which is located toward the centre of the coupler 30.

The coupler 30 must be installed with a specific orientation, with the arrow 42 pointing toward the surface of the well. This is because wear generally first occurs at the bottom section 44 of the centralizer 34 due to the fluid 50 rising up the well. As long as the top section of the centralizer 34 (where the first deposit 36 is located) maintains its diameter, then the top section 42 is able to function as a guide or centralizer for the sucker rod component even if the bottom section 44 is worn.

Any number of deposits can be located at any location within the centralizer can be used as a means of detecting wear according to the present invention.

The coupler 30 optionally has flat sections 46 and 48 so as to allow a spanner to easily grip the coupler 30, so that the coupler 30 can be attached to rod components.

Figure 1:
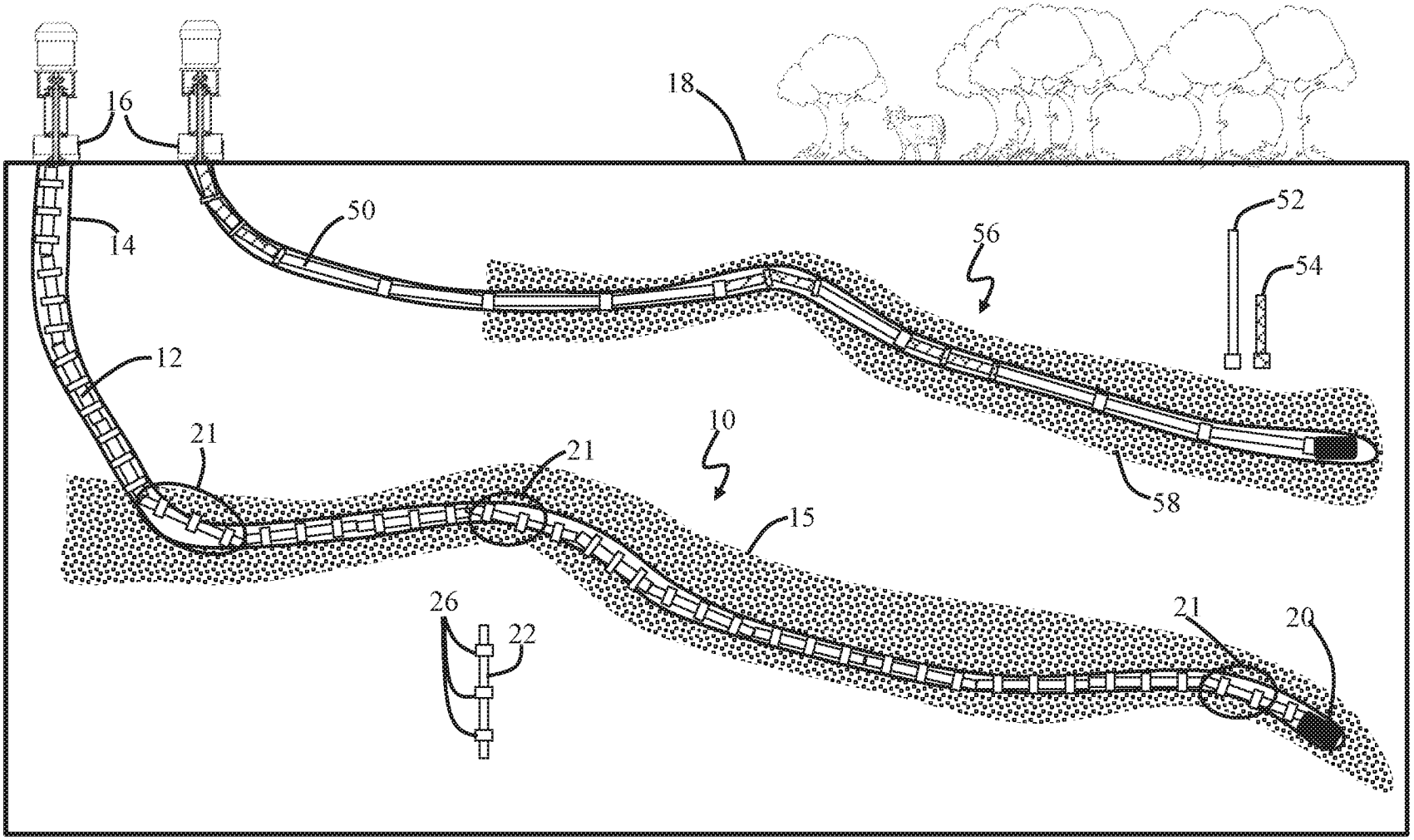
FIG. 1 is a side section representation of two underground wells, wherein the lower well contains a prior art sucker rod string and the upper well contains a sucker rod string according to the present invention.
Figure 2:
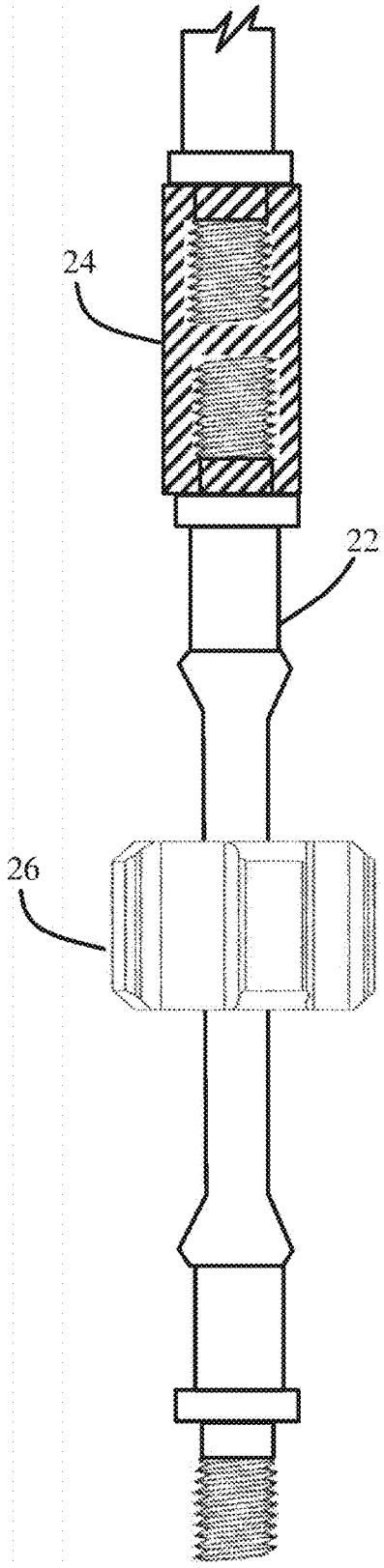
FIG. 2 is side view of a prior art rod component of the sucker rod string of FIG. 1.

According to the present invention, the sucker rod string 50 comprises rod components of different lengths and the rod components of relative shortest length are positioned at points of greatest curvature in a well 56. As shown in FIG. 1, the sucker rod string 50 comprises a long rod component 52 and a short rod component 54. The short rod components 54 are used at the points Where the well 56 curves, as it follows a coal seam 58. The short rod components 54 enable the sucker rod string 50 to avoid or minimise wear at points where the sucker rod string 50 abuts the curved well 56. The path of the well 56 is recorded by computer as the well 56 is drilled. An appropriate sequence of long rod components 52 and short rod components 54 can be automatically computed and numbered to assist the manufacture, installation and repair of the sucker rod string 50. In some embodiments of the invention, the centralizers 34 on the long rod components 52 can have a different chemical signatures to the short rod components 54, so that an operator of the well 56 can determine whether a centralizer 34 on a long rod component 52 in a straight section of the well 56, or a short rod component 54 in a curved section of the well 56 is worn. This greatly reduces the time taken to investigate and repair a fault in the sucker rod string 50 and thereby increases the productivity of the well 56.

In the present specification and claims (if any), the word 'comprising' and its derivatives including 'comprises' and 'comprise' include each of the stated integers but does not exclude the inclusion of one or more further integers.

Reference throughout this specification to one 'embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A wear prevention system for a pumping system of an oil or gas well, the system comprising:

(a) a sucker rod string comprising a plurality of rod components;

(b) a production pipe string;

(c) couplers for the rod components; and (d) one or more centralizers for the rod components within the production pipe, each centralizer defining at least one cavity for containing a signal medium, wherein the cavity is sealed until wear of the centralizer breaches the cavity and the signal medium is released from the cavity;

wherein the centralizers are integrally moulded on the couplers, and wherein the release of the signal medium is detectable at the surface of the well.

2. The wear prevention system of claim 1, wherein the centralizers have cavities at different depths and contain different signal mediums, so that different signals are released for different levels of wear.

3. The wear prevention system of claim 1, wherein the signal medium is located toward the top of the centralizer toward the surface of the well.

4. The wear prevention system of claim 1, wherein the production pipe string has a coating on its inner surface.

5. The wear prevention system of claim 1, wherein the centralizer comprises a pressure densified polymer.

6. The wear prevention system of claim 1, wherein the plurality of rod components comprises a plurality of rod components of relative longest length and a plurality of rod components of relative shortest length, and wherein the rod components of relative shortest length are positioned at points of greatest curvature in the well.

7. The wear prevention system of claim 6, wherein the rod components of relative shortest length have centralizers of the one or more centralizers which contain different signal mediums to the rod components of relative longest length.

8. The wear prevention system of claim 1, wherein the signal medium is a man-made chemical deposit.

9. The wear prevention system of claim 8, wherein the man-made chemical deposit is calcium carbide or nitrates.

10. The wear prevention system as claimed in claim 1, wherein detection is detection of the signal medium, or a result of the signal medium after the signal medium comes into contact with a fluid stream, at the surface after the signal medium, or result, has travelled from the point of release to the surface of the well.

11. A wear prevention system for a pumping system of an oil or gas well, the system comprising:

(a) a sucker rod string comprising a plurality of rod components;

(b) a production pipe string;

(c) couplers for the rod components: and (d) one or more centralizers for the rod components within the production pipe, each centralizer defining at least one cavity for containing a signal medium, wherein the cavity is sealed until wear of the centralizer breaches the cavity and the signal medium is released;

wherein the centralizers are integrally moulded on the couplers, and wherein the signal medium is releasable into a fluid stream and release of the signal medium is detectable at the surface of the well.

12. The wear prevention system as claimed in claim 11, wherein detection is detection of the signal medium, or a result or product of the signal medium after the signal medium comes into contact with the fluid stream, at the surface after the signal medium, or the result, has travelled from the point of release to the surface of the well.

* * * * *